US009076388B2

(12) United States Patent
Lee et al.

(10) Patent No.: US 9,076,388 B2
(45) Date of Patent: Jul. 7, 2015

(54) PIXEL AND ORGANIC LIGHT EMITTING DISPLAY USING THE SAME

(71) Applicant: Samsung Display Co., Ltd., Yongin, Gyeonggi-do (KR)

(72) Inventors: Jae-Sic Lee, Yongin (KR); Chang-Yeop Kim, Yongin (KR); Ok-Byoung Kim, Yongin (KR); Se-Ho Kim, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 106 days.

(21) Appl. No.: 13/841,792

(22) Filed: Mar. 15, 2013

(65) Prior Publication Data

US 2014/0028733 A1 Jan. 30, 2014

(30) Foreign Application Priority Data

Jul. 25, 2012 (KR) ..... 10-2012-0081260

(51) Int. Cl.
*G09G 3/32* (2006.01)

(52) U.S. Cl.
CPC ..... *G09G 3/3266* (2013.01); *G09G 3/3233* (2013.01); *G09G 2300/0819* (2013.01); *G09G 2300/0842* (2013.01); *G09G 2300/0861* (2013.01); *G09G 2310/0262* (2013.01); *G09G 2320/0233* (2013.01); *G09G 2320/045* (2013.01)

(58) Field of Classification Search
CPC . G09G 3/3208; G09G 3/3216; G09G 3/3225; G09G 3/3233; G09G 3/3241; G09G 3/325; G09G 3/3258; G09G 3/3266; G09G 3/3275; G09G 2300/0819; G09G 2300/0842; G09G 2300/0861; G09G 2310/0251; G09G 2310/0262; G09G 2320/043; G09G 2320/045; G09G 2320/0233
USPC ..... 345/76, 82, 205, 214, 690
See application file for complete search history.

(56) References Cited

U.S. PATENT DOCUMENTS

| | | | | |
|---|---|---|---|---|
| 7,209,101 | B2 * | 4/2007 | Abe | 345/76 |
| 8,482,010 | B2 * | 7/2013 | Kanegae | 257/72 |
| 8,552,949 | B2 * | 10/2013 | Miyazawa | 345/92 |
| 2007/0001958 | A1 | 1/2007 | Lee et al. | |
| 2008/0062088 | A1 * | 3/2008 | Chang et al. | 345/76 |
| 2009/0102749 | A1 * | 4/2009 | Kawabe | 345/45 |
| 2011/0267319 | A1 | 11/2011 | Han | |
| 2013/0321375 | A1 | 12/2013 | Ka et al. | |

FOREIGN PATENT DOCUMENTS

| | | | |
|---|---|---|---|
| KR | 10-2007-0002155 | A | 1/2007 |
| KR | 10-2011-0121889 | A | 11/2011 |
| KR | 10-2013-0133500 | A | 12/2013 |

* cited by examiner

*Primary Examiner* — Tom Sheng
(74) *Attorney, Agent, or Firm* — Knobbe Martens Olson & Bear LLP

(57) ABSTRACT

A pixel capable of stably compensating for a threshold voltage is disclosed. The pixel includes an organic light emitting diode (OLED), a driving transistor having a gate electrode, a source electrode, and first and second drain electrodes. The pixel also has a plurality of second transistors serially coupled between the first drain electrode and a gate electrode of the driving transistor, and a node electrically coupled to the second drain electrode and to each of the second transistors.

16 Claims, 4 Drawing Sheets

PIXEL AND ORGANIC LIGHT EMITTING DISPLAY USING THE SAME

CROSS-REFERENCE TO RELATED APPLICATIONS

This application claims priority to and the benefit of Korean Patent Application No. 10-2012-0081260, filed on Jul. 25, 2012, in the Korean Intellectual Property Office, the entire content of which is incorporated herein by reference.

BACKGROUND

1. Field

The present invention relates to a pixel and an organic light emitting display using the same, and more particularly, to a pixel configured to stably compensate for a threshold voltage and an organic light emitting display using the same.

2. Description of the Related Technology

Recently, various flat panel displays (FPD) having reduced weight and volume as compared with cathode ray tubes (CRT) have been developed. The FPDs include liquid crystal displays (LCD), field emission displays (FED), plasma display panels (PDP), and organic light emitting displays.

The organic light emitting displays display images using organic light emitting diodes (OLED) that generate light through re-combination of electrons and holes. The organic light emitting display has high response speed and is driven with low power consumption.

The organic light emitting display includes a plurality of pixels arranged near intersections of a plurality of data lines, scan lines, and power supply lines in a matrix. Each of the pixels commonly includes an organic light emitting diode (OLED), at least two transistors including a driving transistor, and at least one capacitor.

The organic light emitting display consumes low power. However, an amount of current that flows to organic light emitting diodes (OLED) changes in accordance with a deviation in the threshold voltages of the driving transistors included in the pixels so that non-uniformity in display is caused. That is, the characteristics of the driving transistors change in accordance with the manufacturing process variation of the driving transistors included in the pixels. Generally, it is not possible to manufacture all of the transistors of the organic light emitting display to have the same characteristic in current manufacturing processes. Therefore, a deviation in the threshold voltages of the driving transistors is generated.

In order to solve the problem, a method of adding a compensating circuit formed of a plurality of transistors and a capacitor to each of the pixels is suggested. The compensating circuits couple the driving transistors in the form of a diode in a period where scan signals are supplied to compensate for the deviation in the threshold voltages of the driving transistors.

On the other hand, recently, a method of driving a panel at high resolution and/or high driving frequency in order to improve picture quality is suggested. However, when the panel is driven at high resolution and/or high driving frequency, time of the scan signals is reduced so that it is not possible to compensate for the threshold voltages of the driving transistors.

SUMMARY OF CERTAIN INVENTIVE ASPECTS

One inventive aspect is a pixel, which includes an organic light emitting diode (OLED) and a driving transistor including a gate electrode, a source electrode, and first and second drain electrodes. The pixel also includes a plurality of second transistors serially coupled between the first drain electrode and the gate electrode of the driving transistor, and a node electrically coupled to the second transistors and to the second drain electrode of the driving transistor.

Another inventive aspect is an organic light emitting display, including a scan driver configured to supply scan signals to scan lines and to supply emission control signals to emission control lines, and a data driver configured to supply data signals to data lines. The display also includes a plurality of pixels positioned near intersections of the scan lines and the data lines. Each of the pixels includes an OLED and a driving transistor including a gate electrode, a source electrode, and first and second drain electrodes. Each of the pixels also includes a plurality of second transistors serially coupled between the first drain electrode of the driving transistor and the gate electrode of the driving transistor, and a node electrically coupled to each of the second transistors and to the second drain electrode of the driving transistor.

BRIEF DESCRIPTION OF THE DRAWINGS

The accompanying drawings, together with the specification, illustrate exemplary embodiments, and, together with the description, serve to explain various principles and aspects.

DETAILED DESCRIPTION OF CERTAIN INVENTIVE EMBODIMENTS

Figure 1:
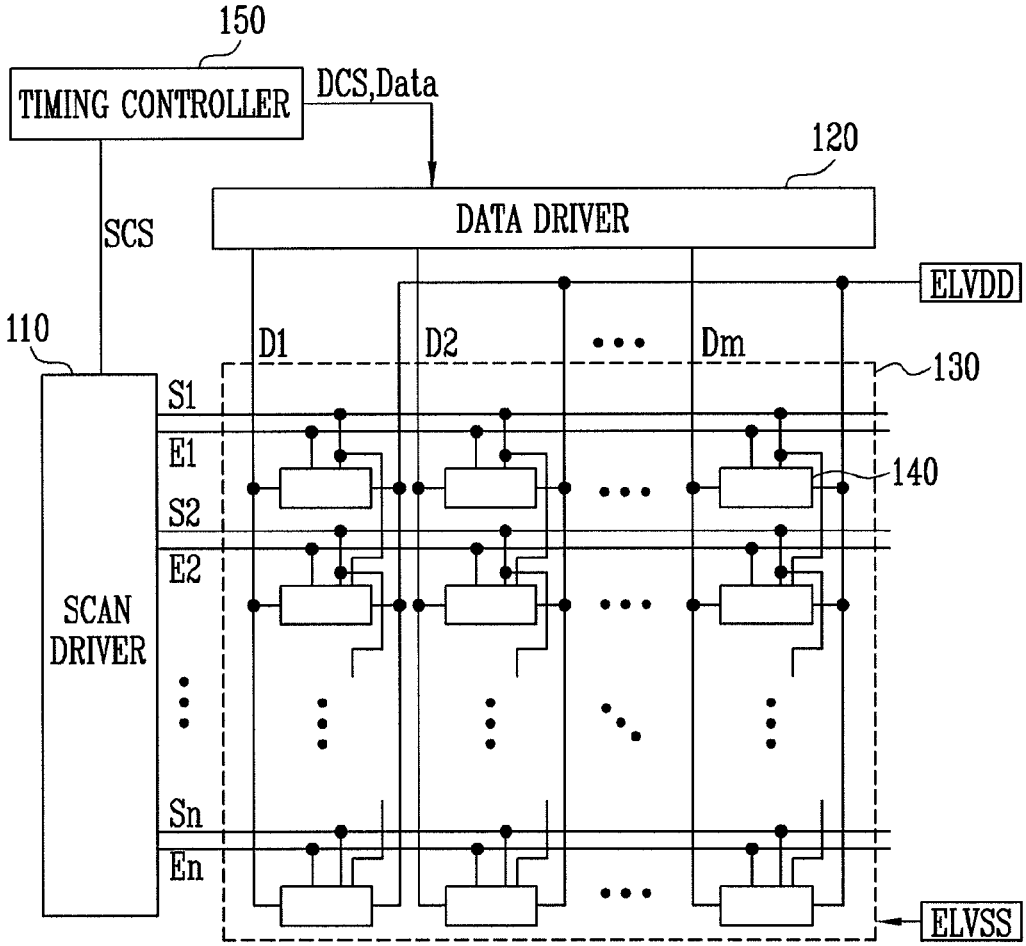
FIG. 1 is a view illustrating an organic light emitting display according to an embodiment.

Hereinafter, certain exemplary embodiments are described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals generally refer to like elements throughout.

Hereinafter, a pixel and an organic light emitting display using the same will be described with reference to FIGS. 1 to 6 in which preferred embodiments are illustrated.

FIG. 1 is a view illustrating an organic light emitting display according to an embodiment. Referring to FIG. 1, the organic light emitting display includes a pixel unit 130 including pixels 140 positioned at the intersections of scan lines S1 to Sn and data lines D1 to Dm, a scan driver 110 for driving the scan lines S1 to Sn and emission control lines E1 to En, a data driver 120 for driving the data lines D1 to Dm, and a timing controller 150 for controlling the scan driver 110 and the data driver 200.

The timing controller 150 generates a data driving control signal DCS and a scan driving control signal SCS to correspond to synchronizing signals supplied from the outside. The data driving control signal DCS generated by the timing controller 150 is supplied to the data driver 120 and the scan driving control signal SCS generated by the timing controller 150 is supplied to the scan driver 110. The timing controller 150 supplies data Data supplied from the outside to the data driver 120.

The scan driver 110 receives the scan driving control signal SCS from the timing controller 150. The scan driver 110 that receives the scan driving control signal SCS generates scan signals and sequentially supplies the generated scan signals to the scan lines S1 to Sn. In addition, the scan driver 110 generates emission control signals in response to the scan driving control signal SCS and sequentially supplies the generated emission control signals to the emission control lines E1 to En. Here, the width, or duration, of the emission control signals is set to be equal to or wider than the width of the scan signals. For example, the emission control signal supplied to an ith (i is a natural number) emission control line Ei overlaps the scan signals supplied to (i-1)th and ith scan lines Si-1 and Si.

The data driver 120 receives the data driving control signal DCS from the timing controller 150. The data driver 120 that receives the data driving control signal DCS generates data signals and supplies the generated data signals to the data lines D1 to Dm in synchronization with the scan signals.

The pixel unit 130 receives a first power supply ELVDD and a second power supply ELVSS from the outside to supply the first power supply ELVDD and the second power supply ELVSS to the pixels 140. The pixels 140 that receive the first power supply ELVDD and the second power supply ELVSS generate light components corresponding to the data signals. On the other hand, the driving transistor included in each of the pixels 140 compensates for a threshold voltage using a first current path and supplies current to an organic light emitting diode (OLED) using a second current path.

Figure 2A:
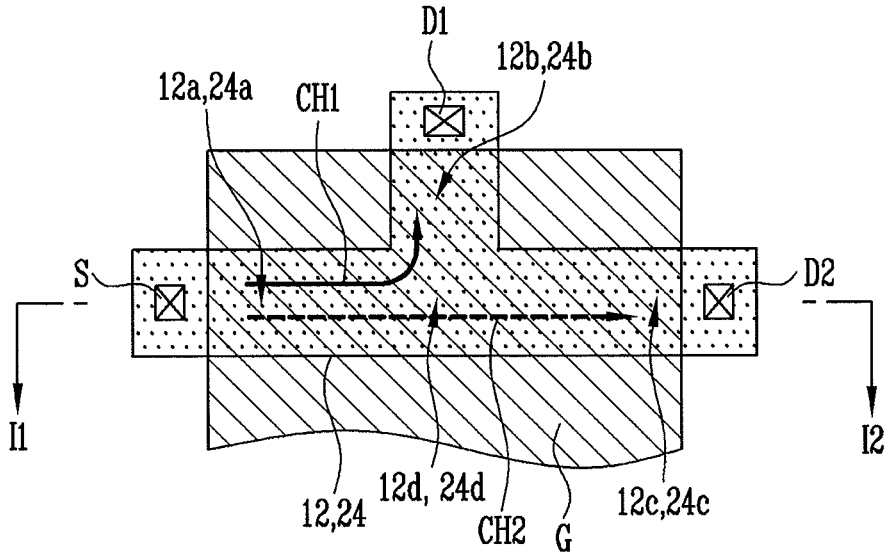
FIG. 2A is a plan view illustrating a driving transistor according to an embodiment.
Figure 2B:
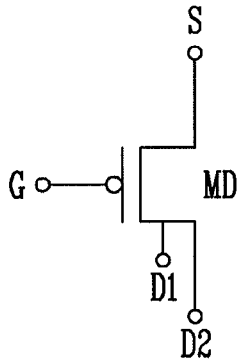
FIG. 2B is a circuit diagram illustrating a driving transistor according to an embodiment.

FIG. 2A is a plan view illustrating a driving transistor according to an embodiment. FIG. 2B is a circuit diagram illustrating a driving transistor according to an embodiment.

Referring to FIGS. 2A and 2B, a driving transistor MD includes semiconductor layers 12 and 24 having source regions 12*a* and 24*a*, first drain regions 12*b* and 24*b*, second drain regions 12*c* and 24*c*, and channel regions 12*d* and 24*d*, a gate electrode G electrically insulated from the semiconductor layers 12 and 24, a source electrode S coupled to the source regions 12*a* and 24*a* of the semiconductor layers 12 and 24, a first drain electrode D1 coupled to the first drain regions 12*b* and 24*b* of the semiconductor layers 12 and 24, and a second drain electrode D2 coupled to the second drain regions 12*c* and 24*c* of the semiconductor layers 12 and 24.

The first drain regions 12*b* and 24*b* are separated from the source regions 12*a* and 24*a* by a first current path CH1. The second drain regions 12*c* and 24*c* are separated from the source regions 12*a* and 24*a* by a second current path CH2 having a different length from the length of the first current path CH1. For example, the second current path CH2 may be formed to be longer than the first current path CH1. In this case, as illustrated in FIG. 2A, in the semiconductor layers 12 and 24, a structure that provides the first current path CH1 may protrude from the central part of a structure that provides the second current path CH2. For example, the semiconductor layers 12 and 24 may be "⊥" or "T" shaped. The structures (semiconductor layers) may be linear or curved as occasion demands.

The gate electrode G is provided to overlap the source regions 12*a* and 24*a* of the semiconductor layers 12 and 24, the channel regions 12*d* and 24*d* that provide the first current path CH1 and the second current path CH2, the first drain regions 12*b* and 24*b*, and the second drain regions 12*c* and 24*c*.

The semiconductor layers 12 and 24 may be formed of amorphous silicon, poly silicon, or oxide semiconductor. The gate electrode G may be formed of poly silicon or metal. The source electrode S, the first drain electrode D1, and the second drain electrode D2 may be formed of metal or alloy.

Figure 3A:
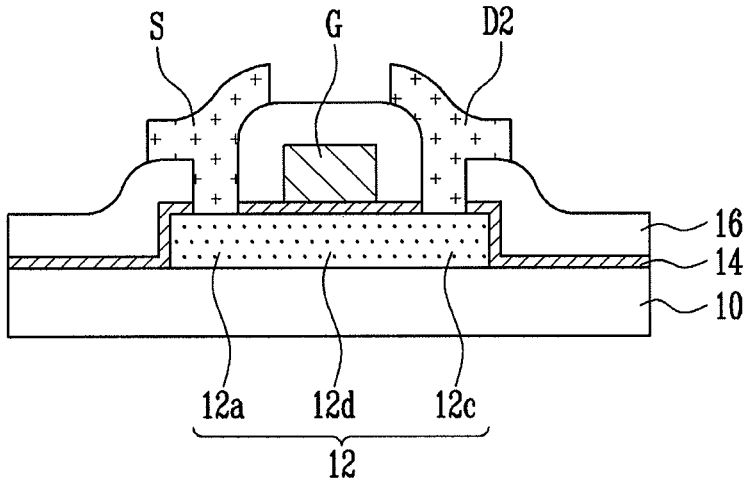
FIG. 3A is a view illustrating a top gate structured driving transistor according to one embodiment.

FIG. 3A is a view illustrating a top gate structured driving transistor according to one embodiment. Referring to FIG. 3A, a semiconductor layer 12 is formed on a substrate 10 and a gate insulating layer 14 is formed on the substrate 10 including the semiconductor layer 12. The gate electrode G is formed on the gate insulating layer 14 on the channel region 12*d*. An interlayer insulating layer 16 is formed on the gate insulating layer 14 including the gate electrode G. Contact holes are formed in the interlayer insulating layer 16 to expose the source region 12*a*, the first drain region 12*b*, and the second drain region 12*c* of the semiconductor layer 12. The source electrode S, the first drain electrode D1, and the second drain electrode D2 are formed to be coupled to the source region 12*a*, the first drain region 12*b*, and the second drain region 12*c* through the contact holes. FIG. 3A is a sectional view taken along the line 11-12 of FIG. 2A. In FIG. 3A, the first drain region 12*b* and the first drain electrode D1 are not illustrated.

Figure 3B:
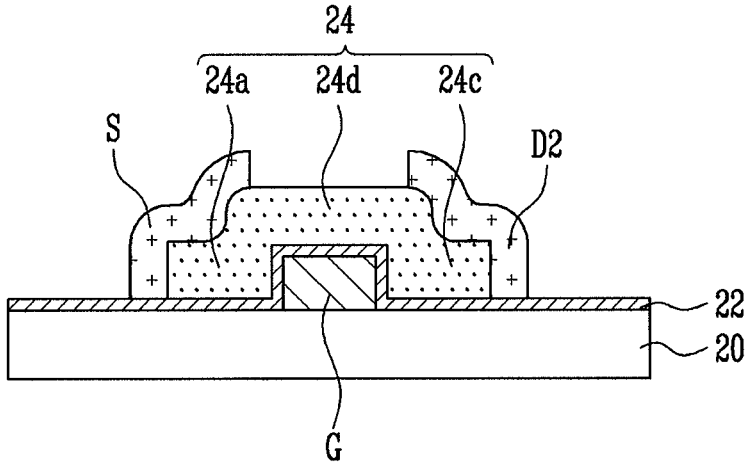
FIG. 3B is a view illustrating a bottom gate structure driving transistor according to another embodiment.

FIG. 3B is a view illustrating a bottom gate structure driving transistor according to another embodiment. Referring to FIG. 3B, the gate electrode G is formed on a substrate 20 and a gate insulating layer 22 is formed on the substrate 20 including the gate electrode G. The semiconductor layer is formed on the gate insulating layer 22 including the gate electrode G. The source electrode S, the first drain electrode D1, and the second drain electrode D2 are formed to be coupled to the source region 24*a*, the first drain region 24*b*, and the second drain region 24*c* of the semiconductor layer 24. FIG. 3B is a sectional view taken along the line 11-12 of FIG. 2A. In FIG. 3B, the first drain region 24*b* and the first drain electrode D1 are not illustrated.

As described above, the driving transistor MD provides the first and second current paths CH1 and CH2 having different lengths. Therefore, currents of different amounts may be simultaneously supplied to correspond to a predetermined voltage applied to the gate electrode. For example, a large amount of current is provided to the first current path CH1 to correspond to the predetermined voltage and a smaller amount of current than the current provided to the first current path CH2 is provided to the second current path CH2.

Here, the first current path CH1 may be used as the threshold path of the driving transistor MD and the second current path CH2 may be used as an emission path for supplying current to the OLED. When the first current path CH1 is used as the threshold path, the threshold voltage of the driving transistor MD may be compensated for in short time to correspond to high current.

Figure 4:
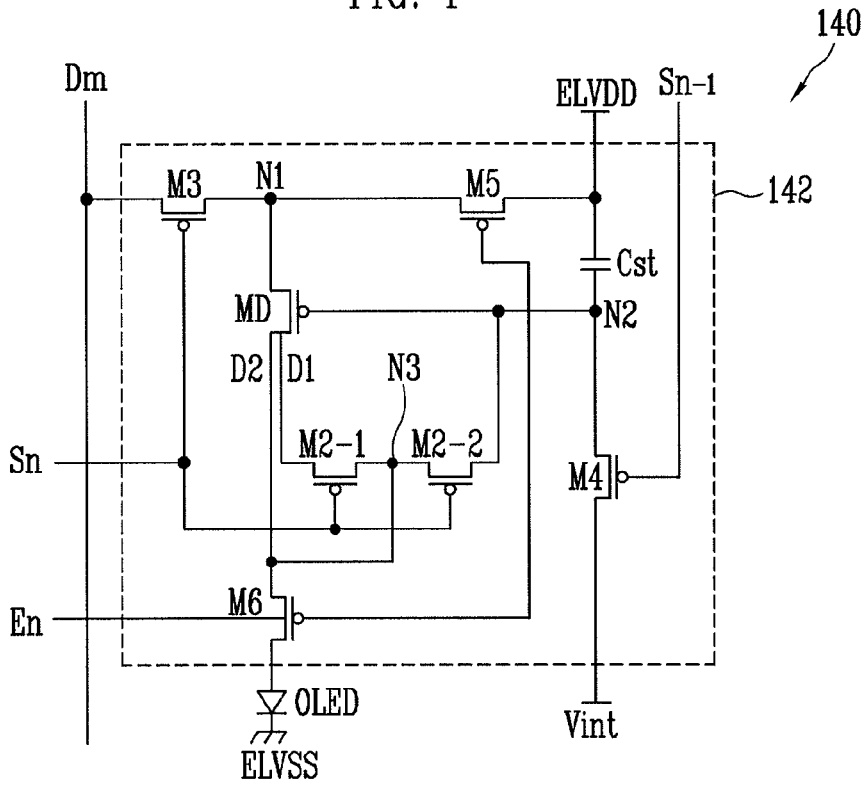
FIG. 4 is a circuit diagram illustrating a pixel according to an embodiment.

FIG. 4 is a circuit diagram illustrating a pixel according to an embodiment. In FIG. 4, for convenience sake, the pixel coupled to the mth data line Dm, the nth scan line Sn, the (n-1)th scan line Sn-1, and the nth emission control line En will be illustrated.

Referring to FIG. 4, the pixel 140 includes an organic light emitting diode (OLED) and a pixel circuit 142 coupled to the data line Dm, the scan lines Sn-1 and Sn, and the emission control line En to control the amount of current supplied to the OLED.

The anode electrode of the OLED is coupled to the pixel circuit 142 and the cathode electrode of the OLED is coupled to the second power supply ELVSS. Here, the voltage value of the second power supply ELVSS is set to be lower than the voltage value of the first power supply ELVDD. The OLED generates light with predetermined brightness to correspond to the amount of current supplied from the pixel circuit 142.

The pixel circuit 142 controls the amount of current supplied to the OLED to correspond to the data signal supplied to the data line Dm when a scan signal is supplied to the scan line Sn. Therefore, the pixel circuit 142 includes a driving transistor MD, second to sixth transistors M2 to M6, and a storage capacitor Cst.

As illustrated in FIGS. 2A and 2B, the driving transistor MD includes the first drain electrode D1 and the second drain electrode D2. The first electrode (source electrode) of the driving transistor MD is coupled to a first node N1 and the gate electrode of the driving transistor MD is coupled to a second node N2. The first drain electrode D1 of the driving transistor MD is coupled to the second transistor M2 and the second electrode D2 of the driving transistor MD is coupled to the sixth transistor M6.

The second transistor M2 is formed of a plurality of transistors positioned between the first drain electrode D1 and the second node N2. Actually, the second transistor M2 includes a first second transistor M2_1 and a second second transistor M2_2. The second transistor M2 is turned on when a scan signal is supplied to the nth scan line Sn to electrically couple the first drain electrode D1 and the second node N2 to each other. On the other hand, a third node N3 that is a common node of the first second transistor M2_1 and the second second transistor M2_2 is coupled to the first electrode of the sixth transistor M6. Coupling between the third node N3 and the sixth transistor M6 is used in the aging process of an initial forwarding process, which will be described later.

The first electrode of the third transistor M3 is coupled to the data line Dm and the second electrode of the third transistor M3 is coupled to the first node N1. The gate electrode of the third transistor M3 is coupled to the nth scan line Sn. The third transistor M3 is turned on when the scan signal is supplied to the nth scan line Sn to supply the data signal supplied to the data line Dm to the first node N1.

The fourth transistor M4 is coupled between the second node N2 and an initializing power supply Vint. The gate electrode of the fourth transistor M4 is coupled to the (n-1)th scan line Sn-1. The fourth transistor M4 is turned on when a scan signal is supplied to the (n-1)th scan line Sn-1 to supply the voltage of the initial power supply Vint to the second node N2. Here, the initializing power supply Vint is set to have a lower voltage than the data signal.

The first electrode of the fifth transistor M5 is coupled to the first power supply ELVDD and the second electrode of the fifth transistor M5 is coupled to the first node N1. The gate electrode of the fifth transistor M5 is coupled to the emission control line En. The fifth transistor M5 is turned on when an emission control signal is not supplied from the emission control line En to electrically couple the first power supply ELVDD and the first node N1 to each other.

The first electrode of the sixth transistor M6 is coupled to the second drain electrode D2 of the driving transistor MD and the second electrode of the sixth transistor M6 is coupled to the anode electrode of the OLED. The gate electrode of the sixth transistor M6 is coupled to the emission control line En. The sixth transistor M6 is turned on when the emission control signal is not supplied to supply current supplied from the second drain electrode D2 of the driving transistor MD to the OLED.

Figure 5:
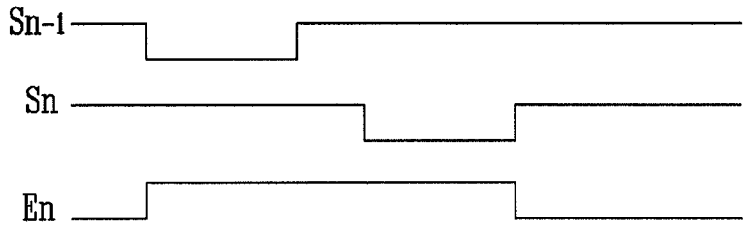
FIG. 5 is a waveform chart illustrating driving waveforms supplied to the pixel of FIG. 4.

FIG. 5 is a waveform chart illustrating driving waveforms supplied to the pixel of FIG. 4. Referring to FIG. 5, first, the emission control signal is supplied to the emission control line En to turn off the fifth transistor M5 and the sixth transistor M6. In this case, the OLED is set to be in a non-emission state.

Then, the scan signal is supplied to the (n-1)th scan line Sn-1 to turn on the fourth transistor M4. When the fourth transistor M4 is turned on, the voltage of the initializing power supply Vint is supplied to the second node N2.

After the voltage of the initializing power supply Vint is supplied to the second node N2, the scan signal is supplied to the nth scan line Sn. When the scan signal is supplied to the nth scan line Sn, the third transistor M3 and the second transistor M2 are turned on.

When the second transistor M2 is turned on, the first drain electrode D1 and the second node N2 are electrically coupled to each other. Then, the driving transistor MD is coupled in the form of a diode by electrical coupling between the first drain electrode D1 and the second node N2. When the third transistor M3 is turned on, the data signal from the data line Dm is supplied to the first node N1. At this time, since the second node N2 is initialized to the voltage of the initializing power supply Vint, the driving transistor MD is turned on. Then, the data signal supplied to the first node N1 is supplied to the second node N2 via the driving transistor MD and the second transistor M2. At this time, the storage capacitor Cst charges a predetermined voltage to correspond to the voltage applied to the second node N2.

On the other hand, in a period during which the scan signal is supplied to the nth scan line Sn, the voltage supplied to the first node N1 is supplied to the second node N2 via the first current path CH1. Therefore, the voltage of the second node N2 increases to correspond to relatively large current so that the threshold voltage of the driving transistor MD may be stably compensated for.

After a predetermined voltage is charged in the storage capacitor Cst, supply of the emission control signal to the emission control line En is stopped so that the fifth transistor M5 and the sixth transistor M6 are turned on. When the fifth transistor m5 and the sixth transistor M6 are turned on, the first power supply ELVDD is electrically coupled to the OLED via the second current path CH2. At this time, the driving transistor MD controls the amount of current that flows to the OLED to correspond to the voltage charged in the storage capacitor Cst.

On the other hand, since the current that flows to the OLED is supplied via the second current path CH2, an image with uniform brightness may be displayed. That is, since a change ratio of current that flows to the second current path CH2 to correspond to an amount of change in the voltage of the second node N2 is small, a data swing range may be increased. In this case, a deviation in current among the driving transistors MD having a characteristic deviation (dispersion) or variation is reduced so that an image with uniform brightness may be displayed. According to the present invention, a predetermined image is displayed on the pixel unit 130 through the above processes.

On the other hand, the second second transistor M2_2 coupled to the gate electrode of the driving transistor MD undergoes the aging process during forwarding. The second second transistor M2_2 is directly coupled to the gate electrode of the driving transistor MD. In the aging process, an off bias voltage is applied to the second second transistor M2_2 to improve the characteristic of the second second transistor M2_2.

Figure 6:
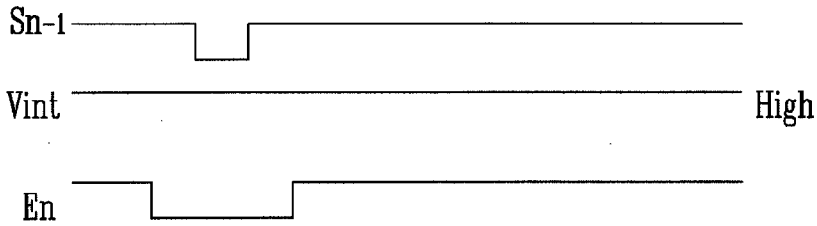
FIG. 6 is a waveform chart illustrating an aging process.

FIG. 6 is a waveform chart illustrating an aging process. Referring to FIG. 6, during the aging process, a high voltage is supplied to the initializing power supply Vint and the emission control signal is supplied to the emission control line En so as not to overlap the scan signal supplied to the (n-1)th scan line Sn-1. That is, in a period where the scan signal is supplied to the (n-1)th scan line Sn-1, a low voltage is supplied to the emission control line En.

When the scan signal is supplied to the (n-1)th scan line Sn-1, a high voltage is supplied to the second node N2 so that the driving transistor MD is turned off. At this time, since the sixth transistor M6 is set to be turned on, the voltage of the second power supply ELVSS is supplied to the third node N3. In this case, the off bias voltage is applied to the second second transistor M2_2 so that a threshold voltage characteristic is initialized to a specific state. Actually, when the second second transistor M2_2 is aged to the off bias voltage, an image with uniform brightness may be displayed during a driving process by initializing the threshold voltage characteristic.

While the present invention has been described in connection with certain exemplary embodiments, it is to be understood that the invention is not limited to the disclosed embodiments, but, on the contrary, is intended to cover various modifications and equivalent arrangements.

What is claimed is:

1. A pixel, comprising:
an organic light emitting diode (OLED);
a driving transistor comprising:
a gate electrode,
a source electrode, and
first and second drain electrodes configured to define different current paths;
a plurality of second transistors serially coupled between the first drain electrode and the gate electrode of the driving transistor; and
a node electrically coupled to the second transistors and to the second drain electrode of the driving transistor.

2. The pixel as claimed in claim 1, wherein the second transistors comprise at least two transistors.

3. The pixel as claimed in claim 1, wherein the current path between the source electrode and the first drain electrode is shorter than the current path between the source electrode and the second drain electrode.

4. The pixel as claimed in claim 1, wherein the driving transistor comprises:
a substrate;
a semiconductor layer formed on the substrate and including a source region, a first drain region separated from the source region by a first current path, and a second drain region separated from the source region by a second current path;
a gate electrode insulated from the semiconductor layer by a gate insulating layer;
a source electrode coupled to the source region of the semiconductor layer;
a first drain electrode coupled to the first drain region of the semiconductor layer; and
a second drain electrode coupled to the second drain region of the semiconductor layer.

5. The pixel as claimed in claim 4, wherein the second current path is longer than the first current path.

6. The pixel as claimed in claim 1, further comprising:
a third transistor coupled between the source electrode of the driving transistor and a data line and configured to be turned on by a scan signal supplied to a current scan line;
a fourth transistor coupled between a gate electrode of the driving transistor and an initializing power supply and configured to be turned on by a scan signal supplied to a previous scan line;
a fifth transistor coupled between the source electrode of the driving transistor and a first power supply and configured to be turned off by an emission control signal supplied to an emission control line;
a sixth transistor coupled between the second drain electrode and an anode electrode of the OLED and configured to be turned off by the emission control signal supplied to the emission control line; and
a storage capacitor coupled between the gate electrode of the driving transistor and the first power supply.

7. An organic light emitting display, comprising:
a scan driver configured to supply scan signals to scan lines and to supply emission control signals to emission control lines;
a data driver configured to supply data signals to data lines; and
a plurality of pixels positioned near intersections of the scan lines and the data lines, wherein each of the pixels comprises:
an organic light-emitting diode (OLED),
a driving transistor, comprising:
a gate electrode,
a source electrode, and
first and second drain electrodes configured to define different current paths;
a plurality of second transistors serially coupled between the first drain electrode of the driving transistor and the gate electrode of the driving transistor; and
a node electrically coupled to each of the second transistors and to the second drain electrode of the driving transistor.

8. The organic light emitting display as claimed in claim 7, wherein the second transistors comprise at least two transistors.

9. The organic light emitting display as claimed in claim 7, wherein the current path between the source electrode and the first drain electrode is shorter than the current path between the source electrode and the second drain electrode.

10. The organic light emitting display as claimed in claim 7, wherein the driving transistor comprises:
a substrate;
a semiconductor layer formed on the substrate and including a source region, a first drain region separated from the source region by a first current path, and a second drain region separated from the source region by a second current path;
a gate electrode insulated from the semiconductor layer by a gate insulating layer;
a source electrode coupled to the source region of the semiconductor layer;
a first drain electrode coupled to the first drain region of the semiconductor layer; and
a second drain electrode coupled to the second drain region of the semiconductor layer.

11. The organic light emitting display as claimed in claim 10, wherein the second current path longer than the first current path.

12. The organic light emitting display as claimed in claim 7, wherein each of the pixels further comprises:

a third transistor coupled between the source electrode of the driving transistor and a data line and configured to be turned on by a scan signal supplied to an ith scan line, wherein i is a natural number;

a fourth transistor coupled between a gate electrode of the driving transistor and an initializing power supply and configured to be turned on by a scan signal supplied to an (i-1) th scan line;

a fifth transistor coupled between the source electrode of the driving transistor and a first power supply and configured to be turned off by an emission control signal supplied to an ith emission control line;

a sixth transistor coupled between the second drain electrode and an anode electrode of the OLED and configured to be turned off by the emission control signal supplied to the ith emission control line; and a storage capacitor coupled between the gate electrode of the driving transistor and the first power supply.

13. The organic light emitting display as claimed in claim 12, wherein the scan driver is further configured to supply the emission control signal to the ith emission control line so as to overlap the scan signals supplied to the ith and (i-1)th scan lines.

14. A pixel, comprising:

an organic light emitting diode (OLED);

a driving transistor comprising:

a gate electrode, a source electrode, and first and second drain electrodes;

a plurality of second transistors serially coupled between the first drain electrode and the gate electrode of the driving transistor, wherein each second transistor includes a gate electrode; and a node electrically coupled to the second transistors and to the second drain electrode of the driving transistor, wherein the gate electrodes of the second transistors are configured to be driven by the same signal.

15. The organic light emitting display as claimed in claim 14, wherein each second transistor further includes source and drain electrodes that are not directly connected to each other.

16. The organic light emitting display as claimed in claim 14, wherein the first and second electrodes of the driving transistor are connected to different elements.

* * * * *